United States Patent [19]

Schuurman

[11] 4,029,054

[45] June 14, 1977

[54] WASTE HEAT BOILER

[75] Inventor: Pieter J. Schuurman, The Hague, Netherlands

[73] Assignee: Shell Oil Company, Houston, Tex.

[22] Filed: Nov. 12, 1975

[21] Appl. No.: 631,246

[30] Foreign Application Priority Data

Jan. 17, 1975 Netherlands ..... 7500554

[52] U.S. Cl. ..... 122/7 R; 165/135; 165/158

[51] Int. Cl.[2] ..... F22B 1/18; F28F 13/00

[58] Field of Search ..... 122/7 R; 165/134, 135, 165/158

[56] References Cited

UNITED STATES PATENTS

| | | | |
|---|---|---|---|
| 3,570,458 | 3/1971 | Sato et al. | 165/135 |
| 3,662,717 | 5/1972 | Haar | 122/7 |
| 3,903,964 | 9/1975 | Van Doorn et al. | 165/135 |

*Primary Examiner*—Kenneth W. Sprague

[57] ABSTRACT

An improved waste-heat boiler for cooling and recovering heat from the hot gaseous product of a partial combustion process is disclosed. The waste-heat boiler contains gas tubes, the straight parts of which protrude through the separation plate between the cooling chamber and the gas inlet chamber into the gas inlet chamber. The straight parts of the gas tubes are surrounded by cooling jackets, which are connected with the inlet ends of the gas tubes. In the ring-shaped spaces between the straight parts of the gas tubes and the cooling jackets axial tubular conducting bodies are present. The axial tubular conducting bodies are connected with coolant supply lines wherein water is pumped for cooling the gas inlet ends.

4 Claims, 2 Drawing Figures

WASTE HEAT BOILER

THE PRIOR ART

Crude synthesis gas produced by the partial combustion of hydrocarbons generally is discharged from the reactor at a temperature of from 1300° to 1400° C or higher, thus making it an obvious source of potential energy. The thermal energy is synthesis gas, however, can be recovered only with great difficulty utilizing conventional heat exchangers, because of the presence in such gas of large amounts of soot (i.e., free carbon), often up to 5 percent or more, which tends to deposit on the inside of the exchange tubes. A number of waste-heat boilers have been proposed for use in recovering heat from such gases, for example, the apparatus described in U.S. Pat. No. 2,967,515 to Hofstede et al. In boilers of this general design, hot gas obtained from the partial combustion of hydrocarbons is introduced into the waste-heat boiler and flowed through one or more straight and/or helically coiled tubes connected at their inlet ends to the bottom plate of the boiler, i.e., the separation plate between the cooling space and the gas supply space. Coolant liquid is normally admitted into the waste-heat boiler through a vertical, radially spaced tube which can be provided with a nozzle so that the coolant is discharged against the hot bottom (separation) plate, after which it ascends upward into the space formed between the coolant tube and the shell of the waste-heat boiler, thereby cooling the straight and/or helically coiled tube or tubes accomodated therein.

Another significant problem encountered in cooling such hot gases is that very often there is a large pressure difference between the hot gases being cooled and the coolant. This occurs for example in a process where a heat exchanger in which water is used as coolant must, for the sake of efficiency, produce steam having a much higher pressure than the gases to be cooled. In view of the large difference in temperature and pressure conditions at which a heat exchanger of this type operates, the mechanical stresses and load to which the heat exchanger is subjected are very high. For this reason, the designing of a heat exchanger suitable to operate under these conditions involves great technical difficulties.

A particular technical difficulty is the design of the separating plate between the gas supply space and the cooling space of the heat exchanger, since it is this part that is subjected to the most drastic conditions. In the case of heat exchanges having a small diameter, by selecting a suitable thickness of the metal of the separating plate a plate may be obtained which is strong enought to permit operation at great temperature and pressure differences, since the total force acting on this plate is relatively small. However, in the case of heat exchangers having a large diameter, in which the total force acting on the separating plate becomes very large as a result of the great difference in pressure, it is not sufficient to design a separating plate of very thick metal, since a greater metal thickness involves a higher average temperature of the metal, such that the strength of the metal is reduced. Further, the temperature difference across the separating plate becomes very large so that thermal stresses occur as a result of which the plate is very liable to collapse.

One means of cooling the separation plate between the cooling space and gas supply space of a waste-heat boiler is disclosed in U.S. Pat. No. 3,662,717 wherein a plurality of spray nozzle arms direct the coolant against the separation plate. Another means to keep separation plate cool is disclosed in U.S. Pat. No. 3,610,329 wherein the gas inlet tubes project the gas supply chamber such that insulation can be provided between the separation plate and the end of the gas inlet tubes. Further disclosed in U.S. Pat. No. 3,610,329 is the use of cooling jackets surrounding the gas inlet tubes protruding into the gas supply space. While the waste-heat boiler described in U.S. Pat. No. 3,619,329 is an improvement, there still is not sufficient prtotection for the ends of the gas inlet tubes found in the gas supply space.

SUMMARY OF THE INVENTION

The present invention is an improved heat exchanger for cooling hot gases with a coolant which exchanger comprises a cooling chamber located vertically above a gas supply chamber having a separation plate disposed between said cooling chamber and said gas supply chamber wherein:

a. said gas supply chamber has an inlet has an inlet for hot gases and at least one gas supply line for discharging the hot gases through said separation plate to said cooling chamber and wherein said gas supply lines have inlets below said separation plate;

b. said cooling chamber has at least one primary coolant supply line, at least one primary coolant discharge line, and at least one cooling pipe communicating at one end with the gas supply lines of said gas supply chamber and exiting the cooling chamber;

c. said gas supply lines are surrounded in said gas supply chamber by cooling jackets which are connected with said separation plate such that spaces are formed between said gas supply lines and said cooling jackets which spaces communicate with the cooling chamber, and wherein the ends of the gas supply lines in said gas supply chamber are connected to said cooling jackets such that an annular space is formed between said gas supply lines and said cooling jackets; and d. a secondary coolant supply line is connected to an axial tubular conducting body disposed within said annular space, said conducting body containing an axial annular chamber in communication with the ends of said secondary coolant supply line and having outflow openings arranged around the inner circumference of the conducting body such that coolant may flow through the coolant supply line to the annular chamber of the conducting body then to the annular space.

DETAILED DESCRIPTION OF THE INVENTION

The present invention relates to a heat exchanger for cooling hot gases, comprising a gas supply space provided with one or more gas supply lines, a cooling space provided with one or more gas discharge lines, one or more coolant supply lines and one or more coolant discharge lines, a separating plate which separates the gas supply space from the cooling space from the cooling space and through which one or more gas pipes pass, the inlet ends of which are located in the gas supply space and which are connected through cooling pipes in the cooling space to the gas discharge lines of the cooling space, the gas pipes in the gas supply space each being surrounded by a cooling jacket which is connected with the separating plate such that the spaces between the gas pipes and the cooling jackets communicate with the cooling space, while in the gas supply space the ends of the gas pipes are connected to the ends of the cooling jackets and axial tubular conducting bodies are connected with ends of coolant supply lines, which conducting bodies divide the bottom parts of the annular spaces into two parts, which are in open communication with each other near the connections of the inlet ends of the gas pipes to the cooling jackets, and which conducting bodies contain axial annular chambers and, arranged in regular fashion around the inner circumference of the conducting bodies, outflow openings from the chambers.

The cooling space is preferably located vertically above the gas supply space. Both the cooling space and the gas supply space may have any desired shape. A suitable shape for these spaces is for example a spherical shape. However, the cooling space and the gas supply space are preferably cylindrically shaped to provide optimum use of the available space.

The separating plate between the gas supply space and the cooling space through which the gas pipes pass may have any shape, and may, for example, be flat. However, in order to increase the strength of the plate as much as possible and consequently to increase the pressure the pressure difference between the cooling space and the gas supply space at which the heat exchanger may be operated, the separating plate preferably has a substantially spherical shape, its convex side facing the gas supply space. The gas pipes, which pass through the separating plate from the gas supply space into the cooling space, are connected to the gas discharge lines of the cooling space by means of cooling pipes. These cooling pipes are preferably helically wound and extend in the direction of the gas pipes.

A concentric inner tube is preferably arranged in the cooling space, which tube forms an annular space with the outer wall of the cooling space. In this case, the pipes intended for cooling are wound around the concentric inner tube in the annular space in such a way that they are evenly distributed over this space. This uniform distribution benefits the heat transfer between the hot gas in the pipes and the coolant around the pipes. One or more coolant supply lines are connected to the cooling space. This connection may be arranged at any point of the cooling space. A suitable location is the lower side of the cooling space near the separating plate between the cooling space and the gas supply space, so that this plate is cooled with relatively cold coolant. Preferably, however, the coolant supply line is connected to the upper part of the concentric inner tube or issues into the lower part of the concentric inner tube. In this case the coolant is forced to flow downwards in the inner tube and upwards in the annular space around the inner tube. By this forced circulation a very good heat transfer is obtained between the hot separating plate and the coolant and between the helically wound cooling pipes and the coolant.

As already mentioned above, the heat exchanger may comprise one or more gas pipes and cooling pipes and gas discharge lines connected therewith. In general, the number of gas pipes selected will not exceed 100 since a larger number will highly complicate the construction. Preferably, 2–50 gas pipes, cooling pipes and gas discharge lines are used.

The inner diameter of the cooling space may be selected within wide limits, depending on the desired degree of cooling and on the desired capacity of the apparatus. The same applies to the inner length of the cooling space. For practical reasons, the inner diameter is advantageously selected in the range from 0.5–10 m and the inner length in the range from 3–30 m. However, it is preferred that the diameter and the length of the cooling space remain within respectively 1–5 and 5–20 m.

The outer circumference of the gas supply space is advantageously equal to that of the cooling space, so that the walls of the two spaces are in line with each other. Because of the very high temperature at which the gases may be passed into the gas supply, this space is preferably lined on the inside with a layer of refractory material. The thickness of this material is preferably selected in the range from 100 to 500 mm and more preferably in the range from 200 to 400 mm. This material is advantageously selected in such a way that it has a heat conductivity in the range from 0.5–10 watt/m° C.

The inlet ends of the gas pipes are located within the gas supply space. The reason for this is to prevent the separating plate between the gas supply space and the cooling space from coming into direct contact with the hot gases. The separating plate would otherwise become too hot and consequently too weak to withstand the high pressure difference between the cooling space and the gas supply space. In the present arrangement, the hot gases are discharged through the inlet ends of the gas pipes without coming into contact with the separating plate. In order to maintain a proper distance between the inlet ends of the gas pipes and the separating plate the sections of the gas pipes present in the gas supply space suitably have a length in the range from 0.2–6 m and preferably in the range from 0.4–2.5 m.

In the gas supply space, the gas pipes are each surrounded by a cooling jacket in such a way that the annular spaces between the gas pipes and the cooling jackets are connected to the cooling space while the inlet ends of the gas pipes are connected to the ends of the cooling jackets. Thus, each individual gas pipe can be readily cooled with coolant. Since the coolant supply lines are connected near the inlet ends of the gas pipes to the axial annular chambers in the tubular conducting bodies and the fresh coolant is passed through the outflow openings between the conducting bodies and the gas pipes downwards along the exterior of the inlet ends of the gas pipes, these inlet ends are cooled best. This is necessary because the inflowing gas has the highest temperature at this point. Poor cooling would result in the inlet ends of the gas pipes also obtaining a very high temperature which they would not be able to withstand. The outflow openings are arranged in regular fashion around the inner circumference of the conducting bodies, so that the coolant is distributed uniformly around the circumference of the gas pipes. This promotes good cooling of the gas pipes. Preferably, the coolant in the axial annular chambers of the conducting bodies is forced to execute a rotary motion, which has a very favorable effect on the regularity of the distribution of the coolant among the axial annular chambers.

Three parts of the cooling jackets of the gas pipes in the gas inlet space may be distinguished: first a section near the inlet end of a gas pipe, secondly a section which is connected to the separating plate and thirdly a central section situated between the two other sections. The cooling jackets are designed in such a way that the sections which are near the inlet ends of the gas pipes have a larger inner diameter than the inner diameter of the central sections while the sections which pass through the separating plate have a smaller inner diameter than the inner diameter of the central sections.

Since the sections of the cooling jackets which are near the inlet ends of the gas pipes preferably have a larger inner diameter than the other sections of the cooling jackets, axial tubular conducting bodies can be readily arranged in each of the annular spaces between these sections of the cooling jackets and the gas pipes, which conducting bodies are connected with the ends of the coolant supply lines, while the said conducting bodies divide the bottom parts of the annular spaces into two parts which are in open communication with each other near the connections between the inlet ends of the gas pipes and the cooling jackets. In this way, it is ensured that coolant introduced through the supply lines connected to the conducting bodies into the annular chambers of the conducting bodies is forced to flow through the outflow openings of the chambers directly along the inlet ends of the gas pipes. In this manner these inlet ends are optimally cooled. This is important because they come into contact with the hot gases which have not yet been subjected to any cooling.

The conducting bodies are preferably so designed so designed that narrow annular axial slots are located between the top of the said conducting bodies and the exterior of the gas pipes. In this manner a small proportion of the coolant can be forced to flow directly upwards between the connecting bodies and the gas pipes, thereby obviating local overheating of the gas pipes near the top of the conducting bodies. Such overheating of the gas pipes might well occur if the top of the conducting bodies were connected to the gas pipes without a passage for coolant. If, on the other hand, the passages between the top of the conducting bodies and the gas pipes are too wide, too much coolant is thereby allowed to flow away upwards, as a result of which the bottom gas pipes would be insufficiently cooled. The narrow annular slots between the top of the conducting bodies and the gas pipes preferably have a thickness in the range from 0.10 to 5 mm.

The difference between the inner diameter of the section of a cooling jacket which is near an inlet end of a gas pipe and the outer diameter of a gas pipe is preferably selected in the range from 8–80 mm. If the thickness of the annular space between the cooling jacket and the gas pipe is smaller than 8 mm, it is difficult to secure therein an axial tubular conducting body to the coolant supply line. If the thickness of this space is greater than 80mm, the outer diameters of the cooling jackets become so large that only a small number of gas pipes can be arranged in the gas supply space.

The axial annular slots located on either side of the conducting bodies between the latter and respectively the gas pipes and the cooling jackets, have a thickness in the range from 1 to 15 mm.

The height of the axial tubular conducting body is preferably in the range from 80–1450 mm, while the sections of the cooling jackets which are near the inlet ends of the gas pipes and which have a larger inner diameter than the remaining sections of the cooling jackets preferably have a length in the range from 82–1500 mm. Consequently, a passage remains between the lower part of the axial tubular conducting bodies and the connections of the cooling jackets with the inlet ends of the gas pipes, and this passage preferably has a height in the range from 1 to 15 mm.

As stated above, the sections of the cooling jackets which are connected to the separating plate, preferably have a smaller inner diameter than the central sections of the cooling jackets. The reason for this is that a resistance is thereby provided for the coolant with flows along the gas pipes through the separating plate into the cooling space. In this manner, a uniform distribution of the coolant over all the cooling jackets is obtained. For practical reasons the difference between the inner diameter of the section of a cooling jacket which passes through the separating plate and the outer diameter of a gas pipe is preferably selected between 2 and 20 mm.

In order to produce a good resistance for the cooling flowing to the cooling space, the narrow annular spaces between the upper parts of the cooling jackets and the gas pipes should have a certain length. This length is preferably in the range from 100–400 mm.

The coolant flows from the relatively wide inlet ends through the central sections of the annular spaces between the gas pipes and the cooling jackets to the relatively narrow outlet ends of the annular spaces. These central sections of the annular spaces preferably have a thickness in the range from 2–40 mm.

The temperature of the coolant which flows through the annular spaces between the gas pipes and the cooling jackets is preferably selected low enough to avoid vapor formation in these spaces, since vapor formation results in disturbance of the coolant flow so that cooling becomes insufficient.

As has been stated before, it is recommended to keep the separating plate between the cooling space and the gas supply space as cool as possible. In addition to the measures mentioned above, further steps can be taken. Thus, it is preferred that the lower part of the separating plate be insulated with refractory material. To this end, an asbestos fiber or mineral wool blanket or a layer of ceramic material may be used. A combination of a heat-resistant blanket and a refractory layer is most satisfactory for this purpose, the blanked being arranged against the separating plate and supported by the ceramic layer. The thickness of the layer of insulating material is preferably not greater than the length of the gas pipes arranged in the gas supply space. This thickness is, therefore, preferably in the range from 0.2–4 m and still more preferably in the range from 0.4–2.5 m. The refractory material preferably has a heat conductivity in the range from 0.5–10 watt/m° C.

A further method to insulate the separating plate of the hot gases in the gas supply space from the hot gases in the gas inlet spaces consists in providing a cooler which surrounds the cooling jacket of the gas pipes and having one or more coolant supply lines and one or more coolant discharge lines. This cooler is preferably box-shaped and is defined by two flat plates which are arranged in two planes perpendicular to the central axis of the gas supply space and which plates are connected by a cylindrical wall arranged concentrically in respect of the central axis of the gas supply space. The two flat plates are also interconnected by pipes surrounding the cooling jackets of the gas pipes. The cylindrical wall of the cooler preferably has a diameter is at least equal to the diameter of a circle defining the joint cooling jackets of the gas pipes at the cooler and which is at most equal to the diameter of the gas inlet space. The distance between the two flat plates of the cooler, in other words, the inner height of the cooler, is preferably in the range from 10–100 mm.

As has been stated above, the cooler contains pipes which surround the cooling jackets of the gas pipes. There must be some clearance between these pipes and the cooling jackets in order to absorb the effects of shrinkage and expansion when the heat exchanger is taken out of operation and started up. However, this clearance may not be too large, since otherwise there is a risk that too much hot gas would leak through it to the separating plate. It has been found that the best result is obtained if the difference between the inner diameter of the pipes surrounding the cooling jackets of the gas pipes and the outer diameter of the cooling jackets at the location where they are surrounded by the pipes is in the range from 0.5 to 3 mm.

The invention also relates to a method for cooling hot gases by means of water, in which this water is at least partly converted into steam. Hot gases originating from a partial combustion of carbon-containing fuels and containing some soot can be cooled with the aid of this method. Gases of this type normally have a temperature in the range from 900°–1500° C and a pressure in the range from 1–100 bar absolute (atmospheres). In such a method, it is preferred to generate saturated steam having a pressure between 50 and 226 bar absolute. To this end, boiler feed water is preferably supplied to the cooling jackets of the gas pipes so that the gas inlet ends of the gas pipes obtain maximum cooling. This type of water generally has a temperature in the range from 0°–350° C. Preferably, recirculation water is supplied to the coolant supply line(s) of the cooling space, which water is derived from a separator in which steam and water are separated. The water has a temperature in the range from 200° to 374° C. In order to make very effective use of the heat exchanger, an appropriate ratio between the quantities of recirculation water and boiler feed water is desired, which quantities are supplied to the coolant supply line(s) of the cooling space and the cooling jackets of the gas pipes respectively. This ratio is preferably in the range from 5 to 10.

As has been stated above, the separating plate between the gas supply space and the cooling space is preferably screened the hot gases by means of a cooler. Relatively cold boiler feed water is preferably supplied to this cooler, which water has a temperature in the range from 0°–100° C and a pressure in the range from 1–100 bar absolute. The pressure in this cooler is preferably selected approximately equal to the pressure of the gas to be cooled. After this water in the cooler has been raised in temperature, it may suitably be pumped to the cooling space through one or more coolant supply lines.

DETAILED DESCRIPTION OF THE DRAWINGS

The invention will now be further described with reference to the drawings, which show a preferred embodiment. The drawings are provided for the purposes of illustration only, and the invention is not to be limited thereto.

Figure 1:
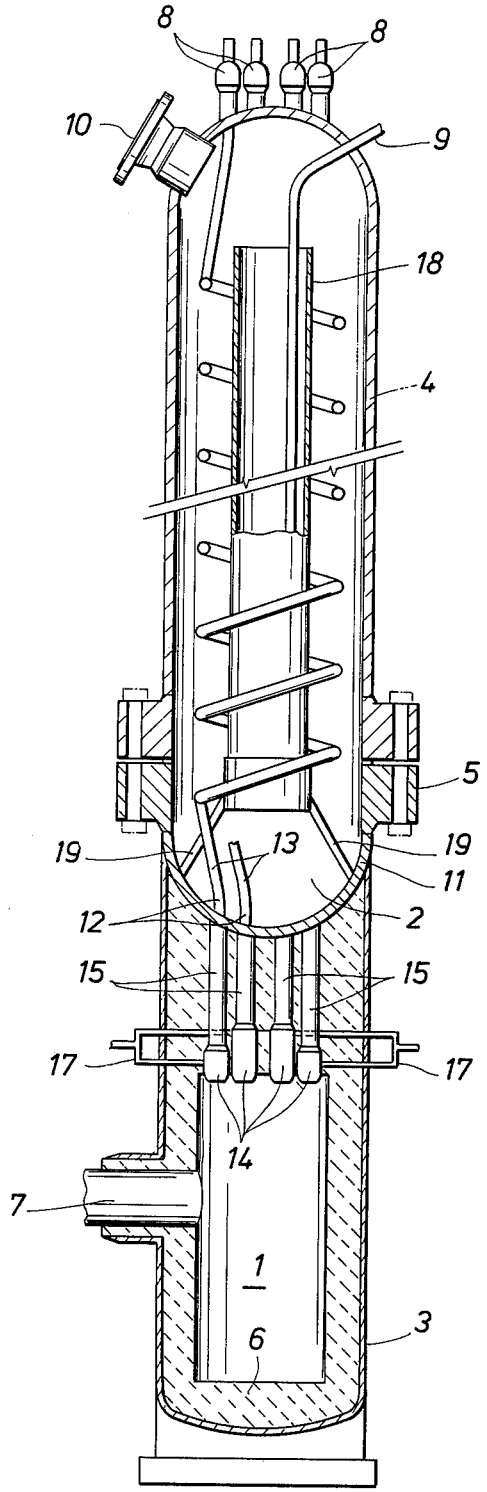
FIG. 1 is a diagrammatic representation of the complete apparatus.
Figure 2:
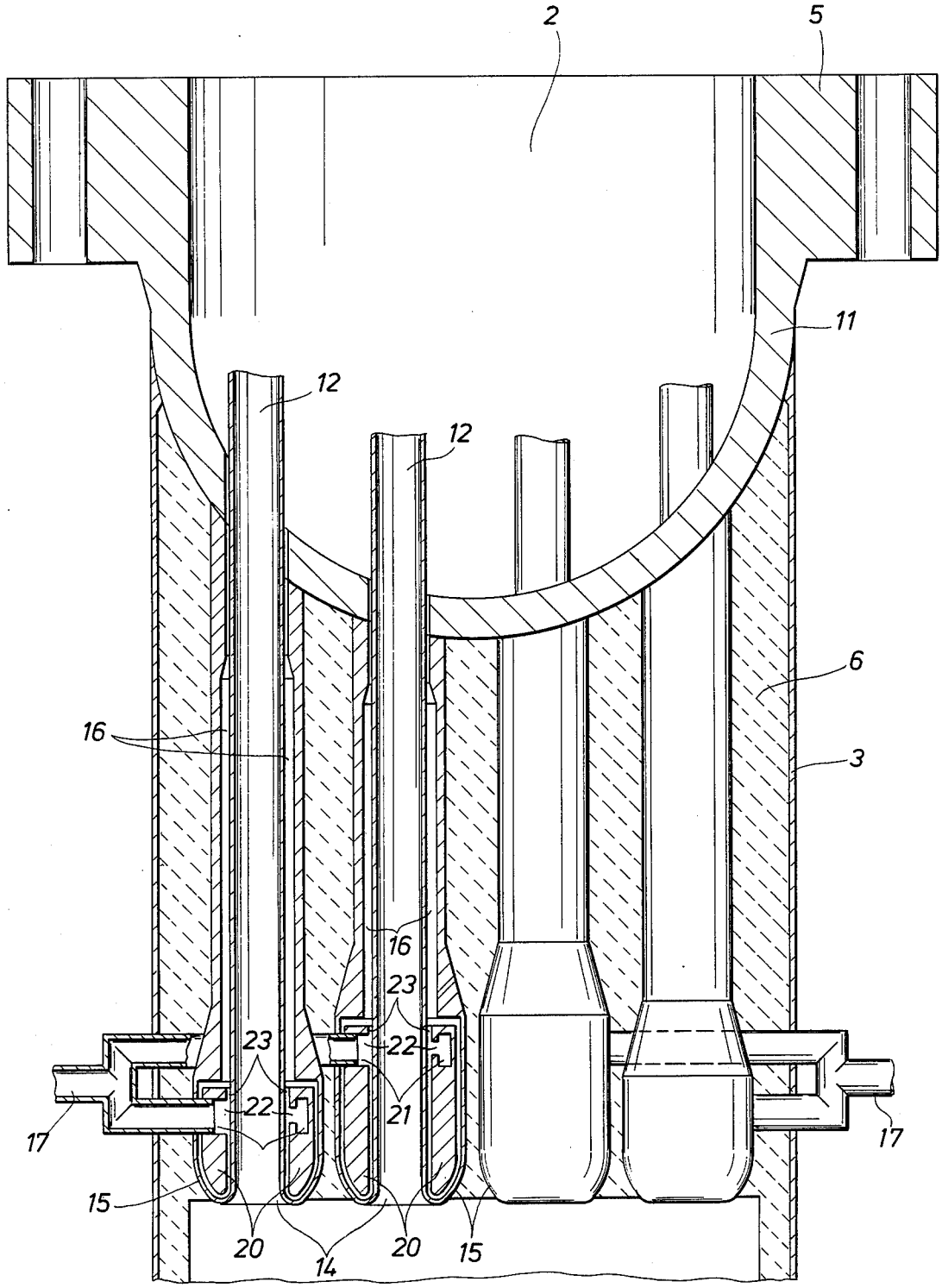
FIG. 2 represents a detail of FIG. 1.

FIG. 1 of the drawing shows a cylindrical heat exchanger consisting of a gas supply space 1 and a cooling space 2. The metal jacket of the gas supply space is designated by the numeral 3 and that of the cooling space by the numeral 4. The cooling space is arranged vertically above the gas supply space. The two metal jackets are interconnected by a flange 5. The gas supply space is lined with refractory material 6 and provided with a gas supply line 7. The cooling space is provided with four gas discharge lines 8, a supply line for coolant 9 and a discharge line for coolant 10. The gas supply space and the cooling space are separated by a separating plate 11 through which four gas pipes 12 pass which are connected to the gas discharge lines 8 of the cooling space 2 via four helical cooling pipes 13 extending through the interior of the cooling space. Only one of the four cooling pipes 13 is shown in full in FIG. 1, a second one is only shown in part and the remaining two have been omitted. The inlet ends 14 of the gas pipes 12 are in the gas supply space 1. The gas pipes 12 are each surrounded by a cooling jacket 15 which passes through the separating plate 11. The spaces 16 between the gas pipes 12 and the cooling jackets 15 communicate with the cooling space 2. The ends 14 of the gas pipes 12 are connected to the ends of the cooling jackets 15. The spaces 16 between the gas pipes 12 and the cooling jackets 15 are connected to supply lines 17 for coolant. In the cooling space 2 a concentric inner tube 18 is arranged around which the cooling pipes 13 have been helically wound. The coolant apply line 9 issues into the lower end of the concentric inner tube 18. The inner tube 18 is connected to the separating plate 11 by means of four supports 19, two of which are shown in FIG. 1. Axial tubular conducting bodies 20 are connected with the parts of the coolant supply lines 17 located near the inlet ends 14 of the gas pipes 12. The conducting bodies 20 contain axial annular chambers 21 and, arranged in regular fashion around the circumference of the conducting bodies, outflow openings 22 from the chambers 21.

The coolant enters the heat exchanger through the coolant supply lines 17. The greater proportion of the coolant first flows into the annular chambers 21, subsequently through the outflow openings 22 between the conducting bodies 20 and the gas pipes 12 downwards along the connections of the inlet ends 14 of the gas pipes 12 with the cooling jackets 15 and then upwards along the exterior of the annular conducting bodies 20. Through the annular spaces 16, the coolant flows into the cooling space 2, then through the coolant discharge line 10.

A small proportion of the coolant flows directly upwards through narrow axial annular slots 23 into the annular spaces 16 and thence together with remaining coolant to the cooling space 2.

The flow of cold coolant along the inlet ends 14 of the gas pipes 12 ensures that the average temperature of the inlet ends 14 is maintained at a low value during the period that hot gases flow through the heat exchanger. The gas pipes 12 are correspondingly reinforced and the heat exchanger can operate safely at very high pressure differences between the hot gases and the coolant. The invention permits a heat exchanger having an internal diameter in the range from 0.5 to 10 m to operate safely in a simple manner at a pressure difference of up to 226 bar absolute.

What is claimed is:

1. A heat exchanger comprising, a first cooling chamber and a second gas supply chamber, the first chamber being vertically aligned above the second chamber, the first chamber and second chamber being commonly bounded by a separation plate at the bottom of the first chamber and the top of the second chamber, the second chamber having an inlet for hot gases;

at least one primary coolant supply line disposed in the first chamber, the first chamber also having at least one primary coolant discharge outlet;

lines for discharging hot gases from the second chamber through the separation plate into the first chamber, and cooling pipes disposed in the first chamber, each of the pipes being in communication at one of their ends with the lines for discharging gases, the other ends of the pipes communicating with outlets for the gases;

cooling jackets surrounding the lines for discharging gases, the cooling jackets contacting the separation plate and the lines in such manner that annular spaces are formed between the lines and the jackets, respectively, and the spaces are in communication with the first chamber through annular openings surrounding each line, but not with the second chamber;

tubular conductive bodies respectively disposed axially around the lines in said spaces, near the entrance of the lines, the conducting bodies containing, respectively, axial annular chambers having outflow openings arranged around the inner circumferences of the conductive bodies;

and a secondary coolant supply line, in communication with the annular chambers of the conducting bodies in such fashion that coolant may flow from the secondary coolant supply line to the annular chambers and thence to the annular spaces.

2. The heat exchanger of claim 1, wherein the separation plate is substantially hemispherical and the convex side of the plate faces the second chamber.

3. The heat exchanger of claim 1, wherein the walls of the second chamber are lined on the inside with refractory material.

4. The heat exchanger of claim 1, wherein the separation plate is lined with refractory material on the side facing the second chamber.

* * * * *